US012460431B2

(12) United States Patent
Davis

(10) Patent No.: US 12,460,431 B2
(45) Date of Patent: Nov. 4, 2025

(54) CONCRETE SCREED DEVICE WITH OSCILLATING SCREED BAR

(71) Applicant: BAD ASS TOOLS LLC, Somers, CT (US)

(72) Inventor: Charles H. Davis, Somers, CT (US)

(73) Assignee: BAD ASS TOOLS LLC, Somers, CT (US)

( * ) Notice: Subject to any disclaimer, the term of this patent is extended or adjusted under 35 U.S.C. 154(b) by 846 days.

(21) Appl. No.: 17/744,020

(22) Filed: May 13, 2022

(65) Prior Publication Data

US 2023/0366217 A1 Nov. 16, 2023

(51) Int. Cl.
*E04F 21/24* (2006.01)
*E01C 19/35* (2006.01)

(52) U.S. Cl.
CPC ..... *E04F 21/242* (2013.01); *E01C 19/35* (2013.01)

(58) Field of Classification Search
CPC ..... E04F 21/242; E01C 19/35
USPC ..... 404/118, 120
See application file for complete search history.

(56) References Cited

U.S. PATENT DOCUMENTS

| | | | |
|---|---|---|---|
| 4,861,188 | A | 8/1989 | Rouillard |
| 5,375,942 | A | 12/1994 | Lindley et al. |
| 5,857,803 | A | 1/1999 | Davis et al. |
| 6,293,780 | B1 | 9/2001 | Rijkers |
| 6,296,467 | B1 | 10/2001 | Rouillard |
| 6,695,531 | B1 | 2/2004 | Prescott |
| 6,976,805 | B2 | 12/2005 | Quenzi et al. |
| 7,052,204 | B2 | 5/2006 | Lutz |
| 7,097,384 | B2 | 8/2006 | Lindley |
| 7,153,058 | B2 | 12/2006 | Lindley |
| 7,156,577 | B1 | 1/2007 | Rozinski |
| 7,175,365 | B1 | 2/2007 | Breeding |
| 7,201,537 | B2 | 4/2007 | Sina |
| 7,320,558 | B2 | 1/2008 | Quenzi et al. |
| 7,491,011 | B2 | 2/2009 | Quenzi et al. |
| 7,651,296 | B2 | 1/2010 | Lindley |
| 8,182,173 | B2 | 5/2012 | Lickel |
| 8,439,600 | B2 | 5/2013 | Brening |
| 8,608,402 | B2 | 12/2013 | Argento et al. |
| 9,091,028 | B1 | 7/2015 | McCary, Sr. et al. |
| 10,968,574 | B2 | 4/2021 | Mikowychok |
| 2009/0092444 | A1 | 4/2009 | Schoen |
| 2020/0087871 | A1 | 3/2020 | Terstriep |

(Continued)

OTHER PUBLICATIONS lowes.com, "Tomahwak Power Manual Concrete Screed," URL: https://www.lowes.com/pd/Tomahawk-Power-37-7cc-Gas-Concrete-Power-Screed-Cement-Finishing-Vibrating-Motor/5000235501?cm_mmc=shp-_-c-_-prd-Discloses; Retrieved: May 16, 2022; 4 pages.

(Continued)

*Primary Examiner* — Raymond W Addie
(74) *Attorney, Agent, or Firm* — CANTOR COLBURN LLP

(57) ABSTRACT

Disclosed is a concrete screed device, having: a handle structure defining a lower end and an upper end spaced apart from each other to define a screed handle structure height; a base bar connected to the lower end of the handle structure; an screed bar disposed against the base bar and configured to oscillate against the base bar; and a motor supported by the screed and operationally connected to the screed bar to oscillate within an oscillatory range of movement against the base bar.

20 Claims, 12 Drawing Sheets

(56) References Cited

U.S. PATENT DOCUMENTS

2023/0128185 A1* 4/2023 McIntosh ..... E01C 19/44
404/118

OTHER PUBLICATIONS northerntool.com, "Wyco Tool Concrete Screed," URL: https://www.northerntool.com/shop/tools/product_200162224_200162224?cm_mmc-Google-Discloses; Retrieved: May 16, 2022; 1 page.

* cited by examiner

Direction of User Travel TR

CONCRETE SCREED DEVICE WITH OSCILLATING SCREED BAR

BACKGROUND

The embodiments are directed to a concrete screed device and more specifically to a concrete screed device with an oscillating screed bar.

A wet screed concrete floor is a type of construction flooring that has an even thickness and surface. Screed work may often require raking concrete at the unleveled side of the bar to prevent the concrete from flowing back under the base bar. Screed work may be laborious and if executed poorly may result in a surface that is uneven or weak.

BRIEF SUMMARY

Disclosed is a concrete screed device, including: a handle structure defining a lower end and an upper end spaced apart from each other to define a screed handle structure height; a screed bar connected to the lower end of the handle structure; a screed bar disposed against the base bar and configured to oscillate against the base bar; and a motor supported by the base bar and operationally connected to the screed bar to oscillate within an oscillatory range of movement against the base bar.

In addition to one or more of the aspects of the device disclosed herein, or as an alternate: the base bar has a first end and a second end spaced apart from each other in a first direction, to define a base bar length, wherein the screed bar is configured to oscillate against the base bar along the first direction; the screed bar has a first end and a second end spaced apart from each other along the first direction, to define a screed bar length that is less than the base bar length; and the screed bar is configured such that it remains between the first and second ends of the base bar throughout the oscillatory range of movement.

In addition to one or more of the aspects of the device disclosed herein, or as an alternate, a difference in length between the base bar and the screed bar is the same as or greater than the oscillatory range of movement.

In addition to one or more of the aspects of the device disclosed herein, or as an alternate, the device further includes a handle portion defined at the upper end of the handle structure.

In addition to one or more of the aspects of the device disclosed herein, or as an alternate, the device further includes a motor control secured to the handle portion and operationally connected to the motor.

In addition to one or more of the aspects of the device disclosed herein, or as an alternate, the device further includes a power supply supported by the screed and electrically coupled to the motor.

In addition to one or more of the aspects of the device disclosed herein, or as an alternate, the device further includes a first wear strip disposed between the screed bar and the base bar.

In addition to one or more of the aspects of the device disclosed herein, or as an alternate, the wear strip member is an HDPE (high density polyethylene).

In addition to one or more of the aspects of the device disclosed herein, or as an alternate: the base bar is L-shaped and includes a first member and a second member connected at a joint; the first member extends along a second direction from the joint to a first outer end, to define a base bar depth; the second member extends along a third direction from the joint to a second outer end, to define a base bar height; the first member also includes a top surface and a bottom surface spaced apart along the third direction, to define a first member depth; the second member includes a front surface and a back surface spaced apart along the second direction, to define a second member depth; and the screed bar is configured to oscillate against the front surface of the second member.

In addition to one or more of the aspects of the device disclosed herein, or as an alternate, the screed bar includes: a top end and a bottom end spaced apart from each other in the third direction, to define an screed bar height; and a front surface and a back surface spaced apart from each other in the second direction, to define an screed bar depth, wherein: the screed bar is a same height as the base bar height, and the top end of the screed bar is aligned in the third direction with the outer end of the second member of the base bar.

In addition to one or more of the aspects of the device disclosed herein, or as an alternate, the front surface of the screed bar is concave to define a shovel or snowplow.

In addition to one or more of the aspects of the device disclosed herein, or as an alternate: the base bar includes a first wear strip member track formed in the front surface of the second member of the base bar; the first track extends along the second member of the base bar, in the first direction, from the first end to the second end of the base bar, so that a first wear strip track length is substantially the same as the base bar length; and the first wear strip is secured to the first wear strip track.

In addition to one or more of the aspects of the device disclosed herein, or as an alternate: the first wear strip extends along the first direction to define a first wear strip length that is substantially the same as first track length; and the first wear strip has a front end and a back end that are spaced apart from each other in the second direction, to define a first wear strip depth; the first wear strip defines a T-shape cross section including: a base portion that extends from the back end to an intermediate location, to define a base portion height, wherein the base portion is sized and shaped to seat within the first track; and a flange portion that extends from the intermediate location to the front end, to define a flange portion height, wherein the flange portion height is smaller than the base portion height, and the flange portion is wider than the base portion.

In addition to one or more of the aspects of the device disclosed herein, or as an alternate: the front surface of the second member of the base bar includes a second track that has a same size and shape as the first track member and is spaced apart from the first track member along the third direction; the device further includes a second wear strip that has a same shape and size as the first wear strip is seated in the second track; and the first and second tracks are located so that the first track is aligned with the top end of the base bar and the second track is aligned with the bottom end of the base bar.

In addition to one or more of the aspects of the device disclosed herein, or as an alternate, the device further includes a guide system, including: a slot defined in the second member of the base bar, the slot extending along the first direction, to define a first and second ends of the slot; a first bearing rod mount connected to the back surface of the second member at the first end of the slot and a second bearing rod mount connected to the back surface of the second member at the second end of the slot; a bearing bar extends from the first bearing rod mount to the second bearing rod mount; a slide bearing mount that extends along the second direction, from the back surface of the screed bar, through the slot; and a guide aperture defined in the slide bearing mount, through which the slide bearing rod extends, permitting only linear movement of the screed bar against the base bar.

In addition to one or more of the aspects of the device disclosed herein, or as an alternate, the device further includes a slide bearing within the slide bearing rod which is configured to engage the bearing mount.

In addition to one or more of the aspects of the device disclosed herein, or as an alternate, the motor is operationally coupled to the slide bearing mount of the guide system such that the motor rotational output is configured to oscillate the screed bar.

In addition to one or more of the aspects of the device disclosed herein, or as an alternate: the guide system is a center slide bearing mount located near the motor, and the device includes: a first outer slide bearing mount that is configured the same as the center guide system and is located near the first end of the base bar; and a second outer slide bearing mount that is configured the same as the center slide bearing mount and is located near the second end of the base bar.

In addition to one or more of the aspects of the device disclosed herein, or as an alternate, the device further includes a retractable stand, mounted to the handle member.

In addition to one or more of the aspects of the device disclosed herein, or as an alternate, the handle structure defines plural segments between the lower end and the upper end that are pivotally interconnected, to adjust a height of the device.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Generally, and as provided in greater detail below, the disclosed embodiments provide a concrete screed device (or leveler) that removes excess concrete off of a top surface of wet concrete. The embodiments do not rely on the rakers. By utilizing the embodiments, flatter surfaces are obtainable. Stone aggregate remains close to the surface where it is most beneficial for surface strength. The embodiments avoid a thick layer of fines at the surface. The screed is capable of instant stopping and restarting on a wet slab and is light enough so it does not sink or damage a finished surface. A base bar is capable of gliding over wet concrete peaks or troughs and providing a level and finished surface. The screed is electrically controlled and optionally runs on a battery, such as a common 36 V tool battery (as a non-limiting example). Thus the screed produces minimal noise, no exhaust pollutants, does not require throttle cables, pull cords, oil, fuel or spark plugs of other screeds.

Figure 1:
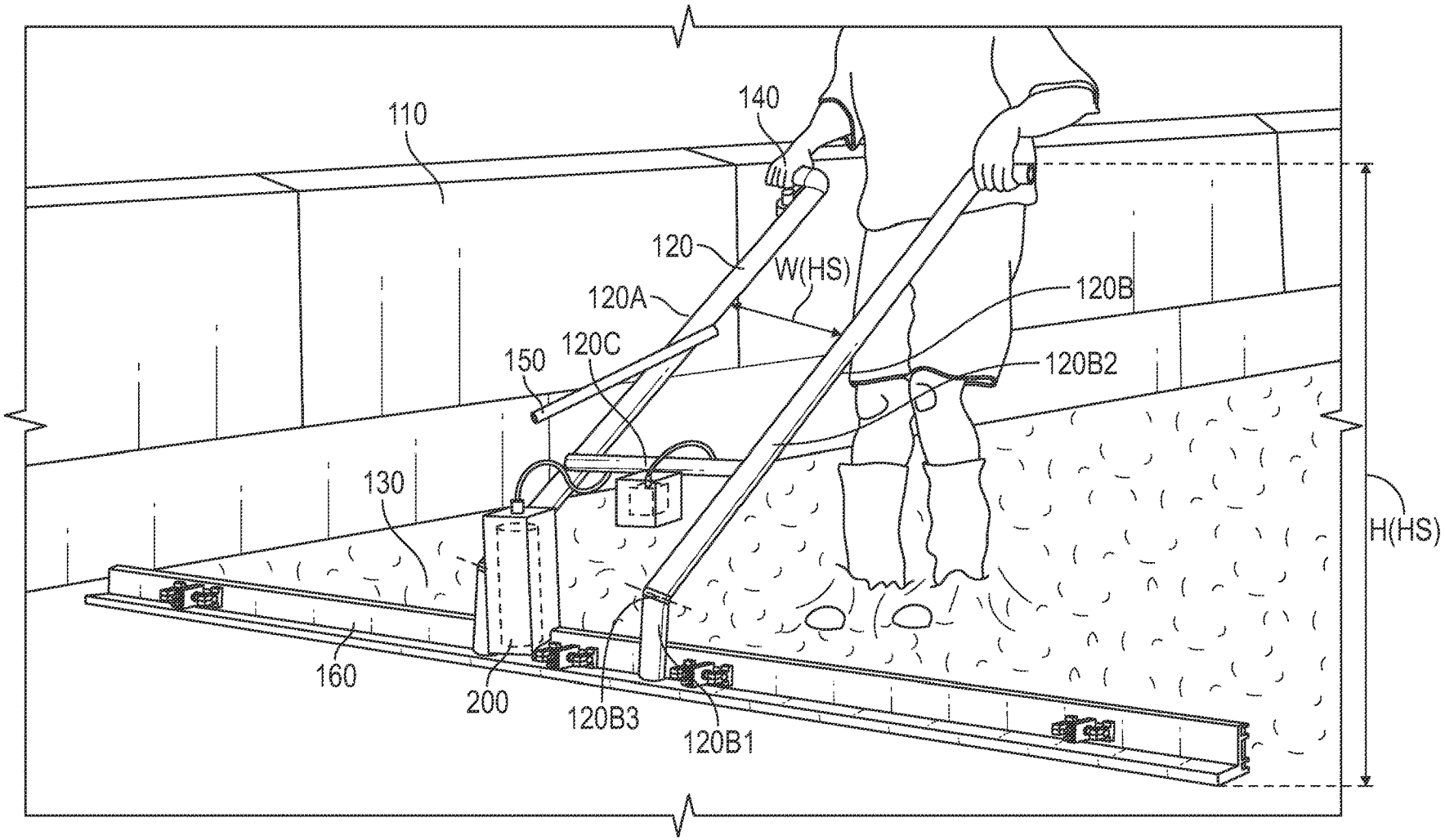
FIG. 1 shows a perspective view of a concrete screed device (or screed) according to an embodiment.

Turning to FIG. 1, disclosed is a concrete screed device (or for simplicity, a screed) 110. The screed 110 may include a handle structure 120. The handle structure 120 may be metal and for example aluminum. The handle structure 120 may define a lower end 130 and an upper end 140 spaced apart from each other, to define a screed handle structure height H (HS). The handle structure 120 may include a first elongate member (or first handle) 120A and a second elongate member (or second handle) 120B that are spaced apart from each other, to define a screed handle structure width W(HS). A crossmember 120C may be provided between the elongate members 120A, 120B for stability.

The screed handle structure height may be such that a person moving the screed 110 can do so comfortably while standing upright. For example the screed handle structure height may be between four and six feet, as non-limiting examples. When the screed 110 is utilized, the handle structure 120 may be angled to the vertical direction, which is typical for utilizing push/pull implements. A pivotal support leg 150 may be provided to support the handle structure 120 when the screed 110 is not being utilized or to temporarily support the screed 110 while in use. The support leg 150 may be pivotally connected to, for example, the first elongate member 120A.

The lower end 130 of each member 120A, 120B may define a first segment, e.g., 120B1. Extending from the first segment 120B1 to the upper end 140 may be a second segment, e.g., 120B2. The segments 120B1, 120B2 may be joined at a pivot 120B3 (shown schematically) to enable height adjustment of the handle structure 120.

FIG. 1 also shows a base bar 160 and motor 200, discussed in greater detail below. As discussed in greater detail below, the base bar has two purposes, to serve as a mounting place for all of the appendages (motor, handles, slide bearing mounts, etc.) and to serve as its ability to float on wet concrete. The screed bar (agitator bar) provides oscillating motion, screeding the concrete.

Figure 2:
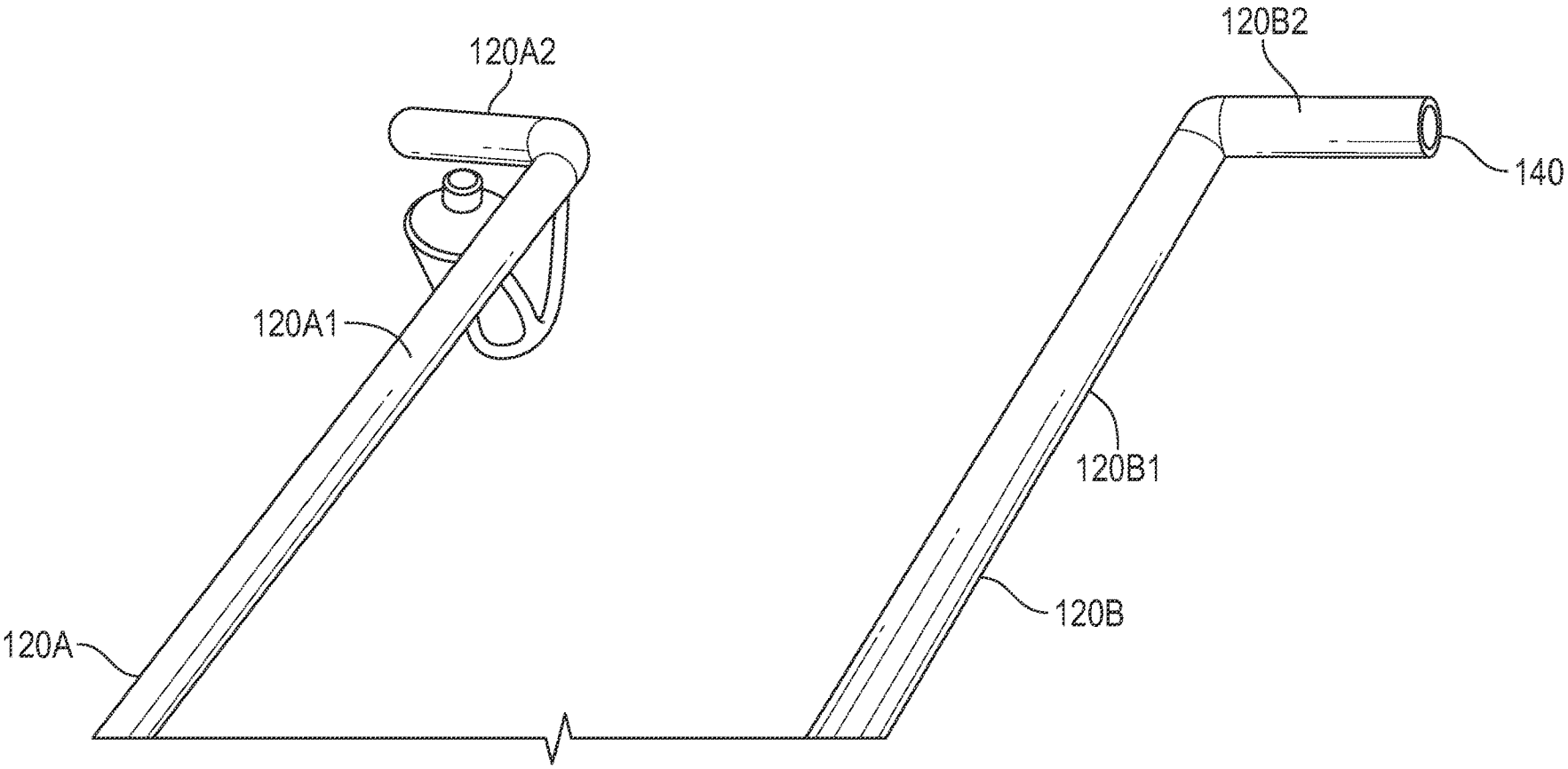
FIG. 2 shows a handle of a handle structure of the screed.

Turning to FIG. 2, the upper end 140 of the handle structure 120, and more specifically the upper ends 120A1, 120B1 of the first and second elongate members 120A, 120B, may define handle portions 120A2, 120B2. The handle portions 120A2, 120B2 may extend away from each other or may form other configurations that are capable of being gripped. It is within the scope of the embodiments to have a tow attachment on the handle structure 120 rather than, or in addition to, handle portions 120A2, 120B2.

Figure 3:
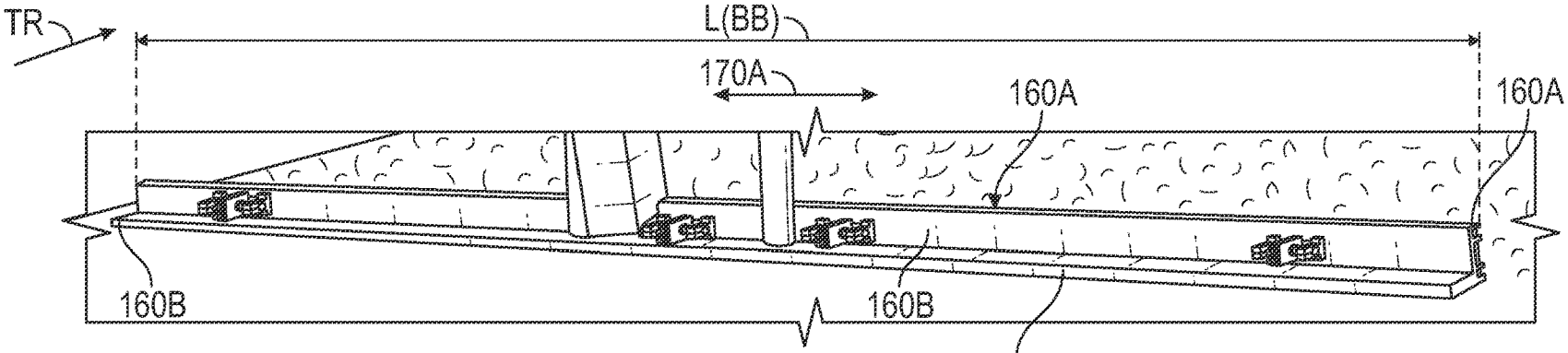
FIG. 3 shows back view of the screed, showing a base bar of the screed.

As shown in FIG. 3, a base bar 160 may have a front side 160A and a back side 160B, defined along a direction of device travel TR in operation. The back side 160B may be connected to the lower end 130 of the handle structure 120.

The base bar 160 may be the same material as the handle structure 120. The base bar 160 may have a first end 160A and a second end 160B spaced apart from each other in a first direction 170A, to define a base bar length L(BB).

Figure 4:
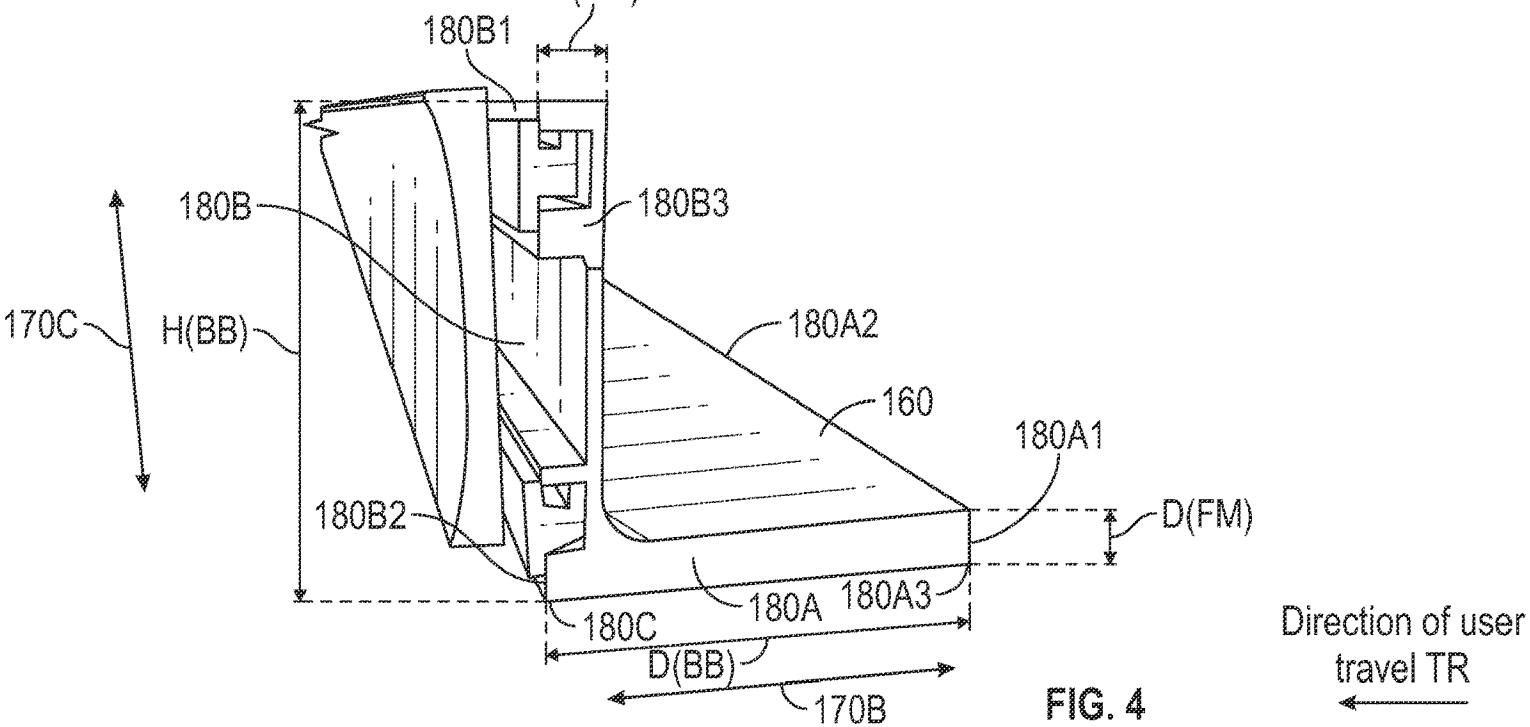
FIG. 4 shows a side view of the screed device.

As shown in FIG. 4, the base bar 160 may be L-shaped in cross-section and include a first member 180A and a second member 180B connected at a joint 180C. The first member 180A may extend from the joint 180C to a first outer end 180A1 along a second direction 170B, toward the back of the screed, to define a base bar depth D(BB). The second member 180B may extend from the joint 180C to a second outer end 180B1 along a third direction 170C, to define a base bar height H(BB). The first member 180A may also include a top surface 180A2 and a bottom surface 180A3 spaced apart along the third direction 170C, to define a first member depth D(FM). In operation, the bottom surface 180A3 of the first member 180A glides over wet concrete. The second member 180B may include a front surface 180B2 and a back surface 180B3 spaced apart along the second direction 170B to define a second member depth D(SM).

Figure 5:
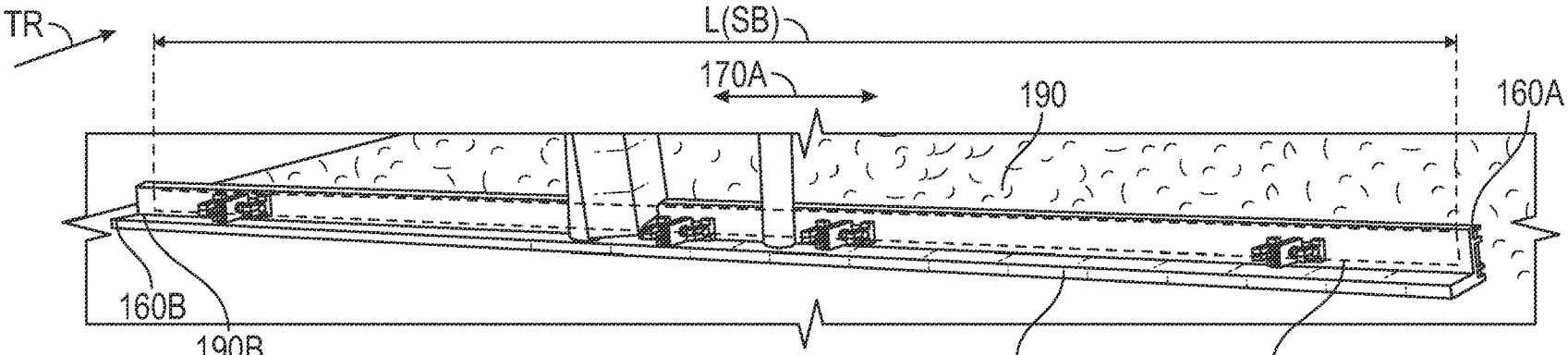
FIG. 5 shows the base bar as shown in FIG. 3 and further shows a base bar (in dashed lines) of the screed because the screed bar is located on the front side of the base bar.

As shown in FIG. 5, a screed bar 190 may be disposed against the front side of the base bar 160 and be configured to move, or oscillate, against the base bar 160, along the first direction 170A. More specifically, the screed bar 190 may be configured to oscillate against the front surface 180A3 of the second member 180B of the base bar 160 within an oscillatory range of movement (or oscillatory amplitude). For example, the oscillatory range of movement may be one inch, as a non-limiting example. The screed bar 190 may be the same material as the base bar 160. The screed bar 190 may have a first end 190A and a second end 190B spaced apart from each other in along the first direction 170A, to define a screed bar length L(SB) that may be less than the base bar length. The screed bar 190 may be configured such that it remains between the first and second ends 190A, 190B of the base bar 160 throughout the oscillatory range of movement. That is, a difference in length between the base bar 160 and the screed bar 190 may be the same as or greater than oscillatory range of movement.

Figure 6:
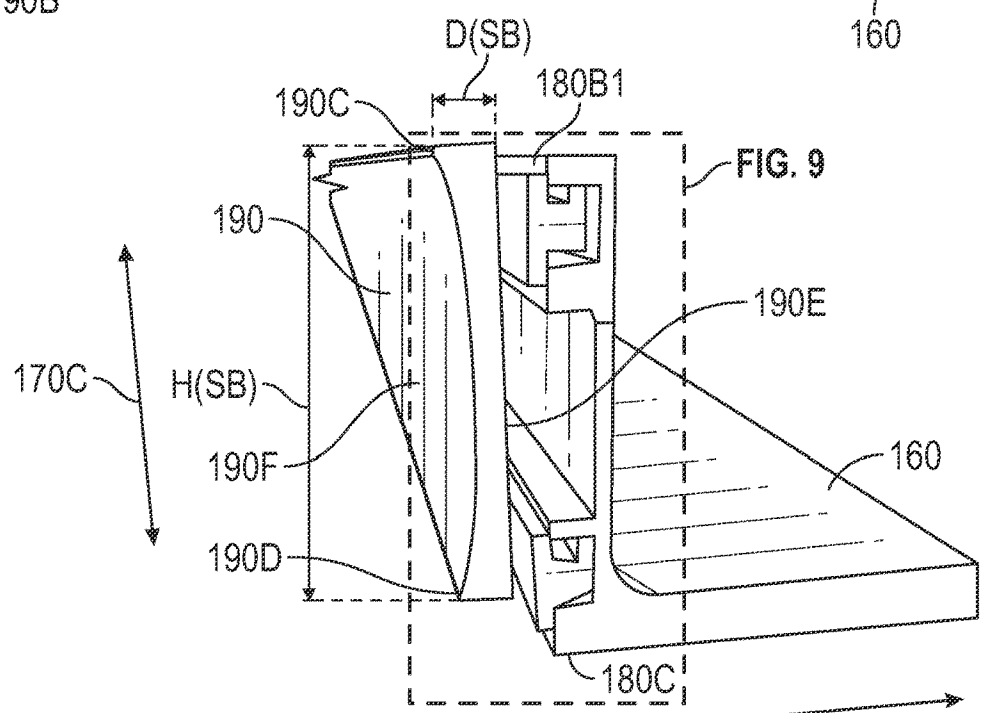
FIG. 6 shows the base bar as shown in FIG. 4 and labels features the base bar attached to the base bar.
Figure 6:
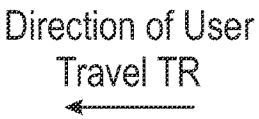

As shown in FIG. 6, the screed bar 190 may include a top end 190C and a bottom end 190D spaced apart from each other along the third direction 170C, to define a screed bar height H(SB). The screed bar 190 may include a back surface 190E and a front surface 190F spaced apart from each other along the second direction 170B, to define a screed bar depth D(SB). The screed bar height may be the same as the base bar height, e.g., between the joint 180C of the base bar 160 and the outer end 180B1 of the second member 180B of the base bar 160. The front surface 190F of the screed bar 190 may be concave. With this configuration, the screed bar 190 may be curved in shape as a shovel or snowplow or moldboard or to decrease backpressure while moving the screed 110 against wet concrete, e.g., to enable concrete to roll over the screed more easily. The top end 190C of the screed bar 190 may be aligned in the third direction 170C with the outer end 180A1 of the second member 180B of the base bar 160. The screed bar 190 may be a same size in the third direction 170C as the second member 180B of the base bar 160. With this configuration the second member 180B may glide along the wet concrete and while the screed bar 190 engages the wet concrete.

Figure 7:
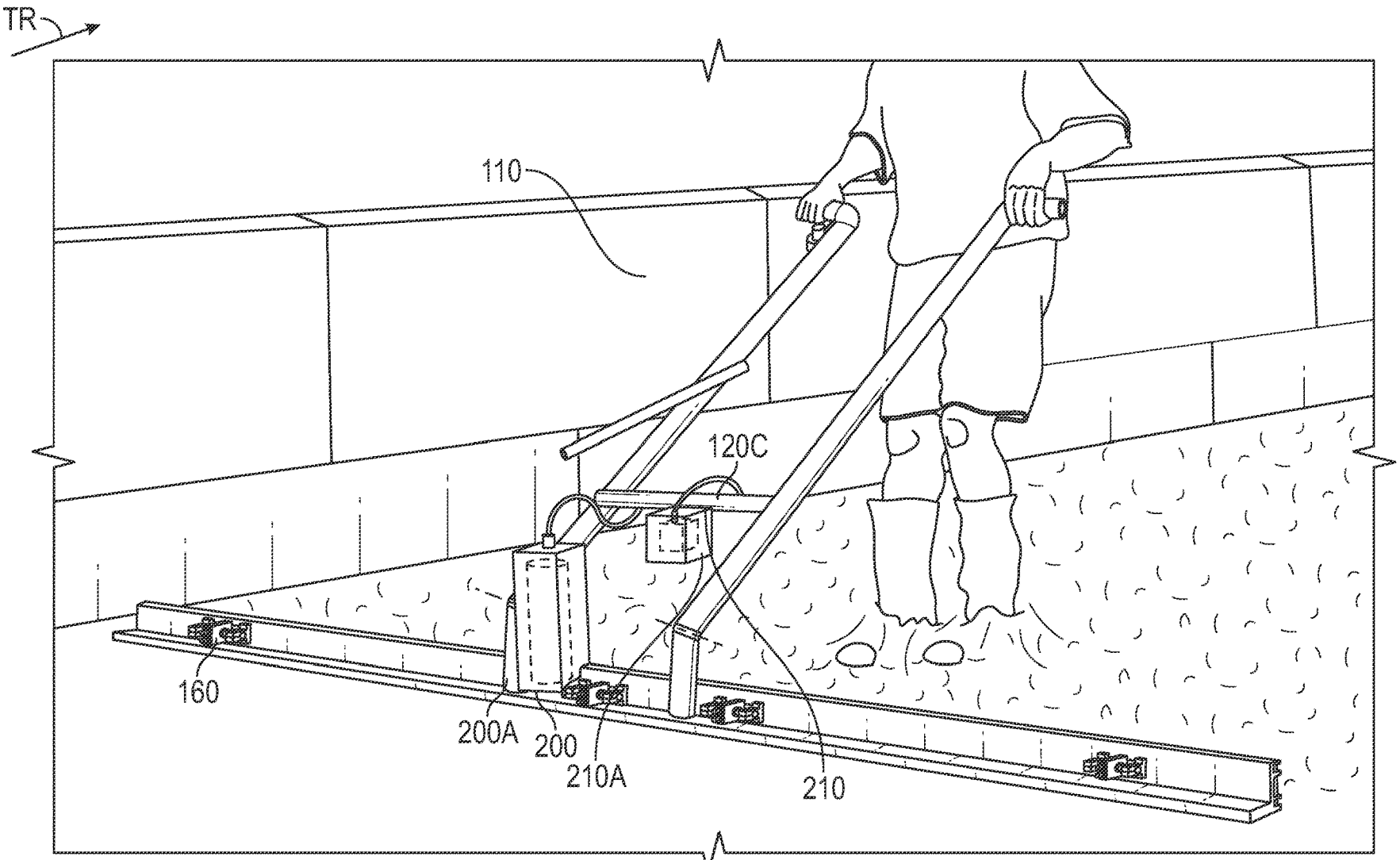
FIG. 7 shows the screed as shown in FIG. 1 and labels features of a motor and power supply.

Turning to FIG. 7, a motor 200 may be supported by the screed 110. The motor 200 may be operationally connected to the screed bar 190, as discussed in greater detail below, to oscillate the screed bar 190. As shown, the motor 200 may be supported in a motor housing (or motor tray) 200A that is fixed to the base bar 160. A power supply 210 may be supported by the screed 110 and electrically coupled to the motor 200. As shown, the power supply 210 may be supported in a power supply housing (or power supply tray) 210A that is fixed to the crossmember 120C. In one embodiment, the battery is mounted directly to the motor.

Figure 8:
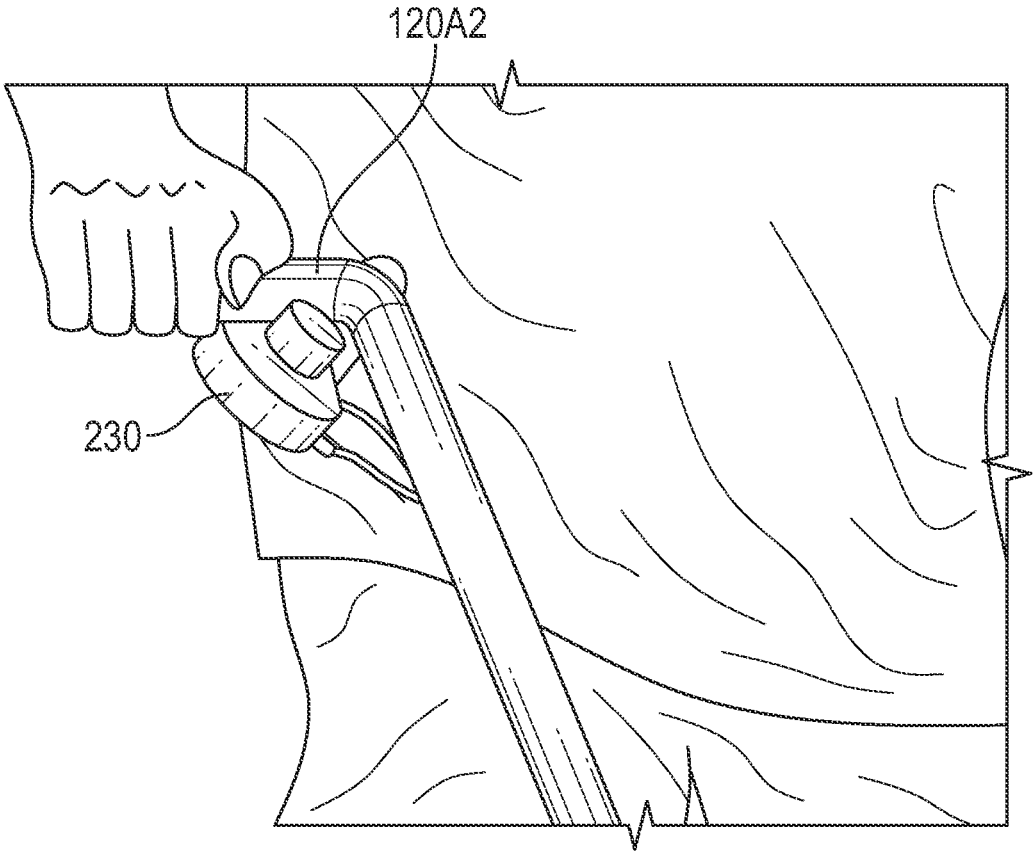
FIG. 8 shows motor controls secure to the handle structure.

As shown in FIG. 8, a motor control 230 may be secured to one of the handle portions 120A2, 120B2, and operationally connected to the motor 200. As shown, the motor control 230 is connected to the first handle portion 120A2. The motor control 230 may be configured to turn the motor 200 on and off as well as to change a rotational speed of the motor 230 depending on conditions of the wet cement.

Figure 9:
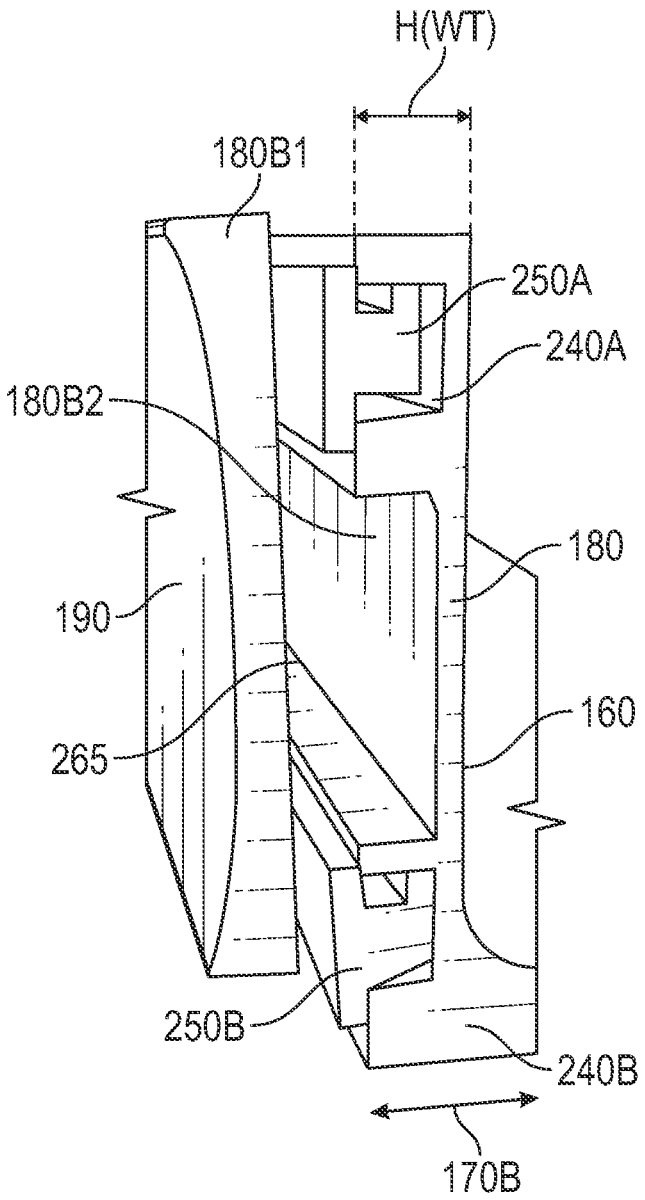
FIG. 9 shows a detail of FIG. 6, identifying a wear strip track formed in the base bar.

Turning to FIG. 9, the base bar 160 includes a wear strip track 240A formed in the front surface 180B2 of the second member 180B of the base bar 160. As shown in the figure, the first track 240A extends outwardly in the second direction 170B from second member 180B of the base bar 160 to define a wear track height H(WT). A cross-sectional shape of the first track 240A may be a U-shape. As shown in the figure, the first track 240A may be formed near the outer end 180B1 of the second member 180B of the base bar 160. FIG. 9 also shows the screed bar 190, a mounting channel 265 (discussed below) and a second wear strip track 240B (discussed below) and top and bottom wear strips 250A, 250B (discussed below).

Figure 10:
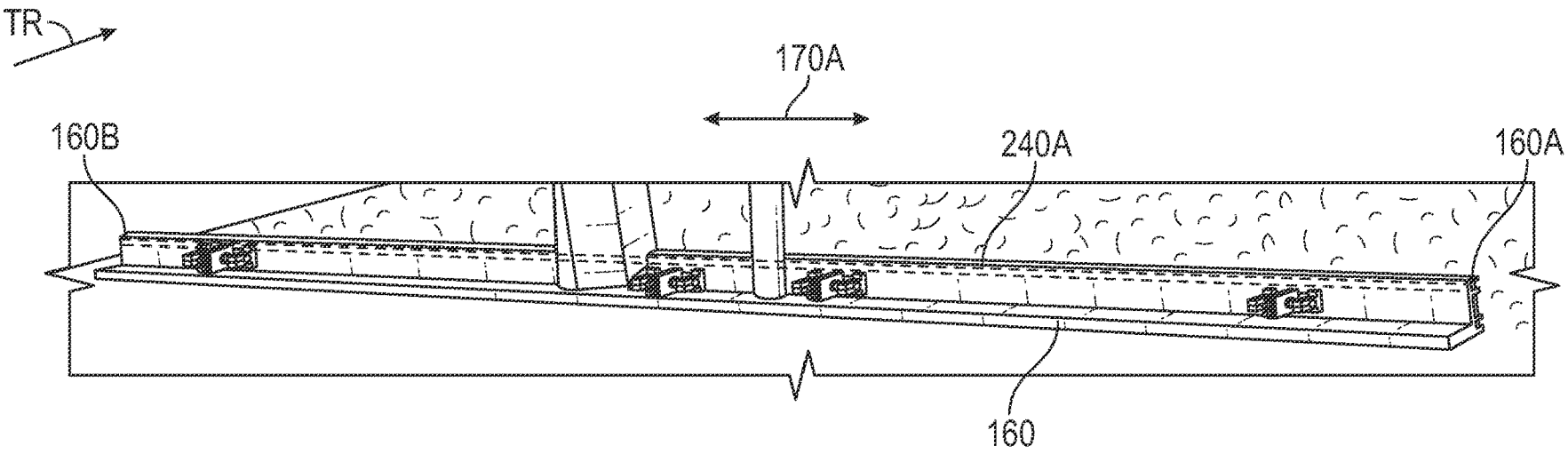
FIG. 10 shows the base bar as shown in FIG. 3 and further shows the wear strip track (in dashed lines) of the screed.

As shown in FIG. 10, the first track 240A may extend in the first direction 170A along the second member 180B of the base bar 160 from the first end 160A to the second end 160B of the base bar 160. With this configuration a first track member length is substantially the same as the base bar length.

Figure 11:
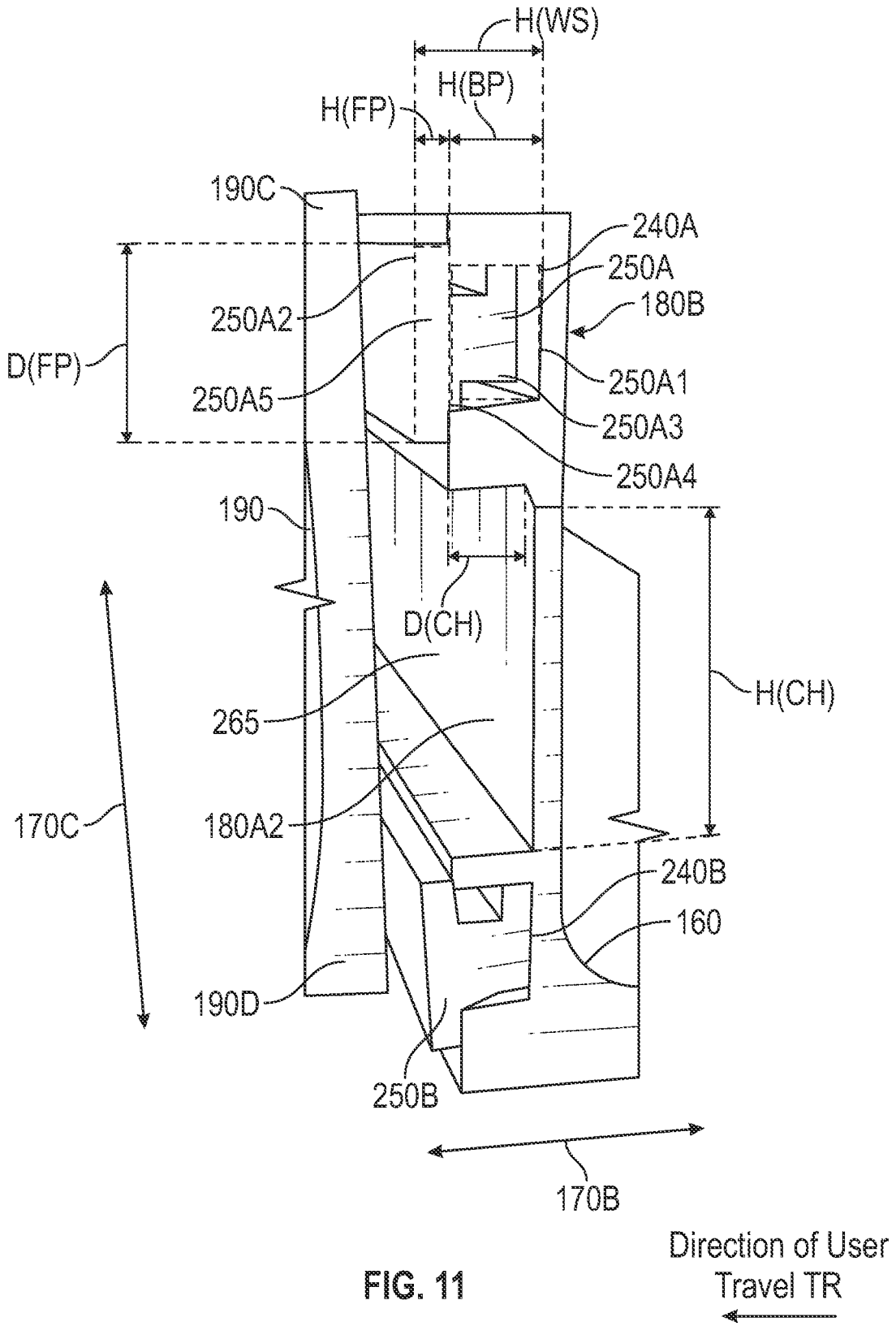
FIG. 11 shows the detail of FIG. 6, identifying wear strip tracks formed in the base bar and wear strips within the tracks.

As shown in FIG. 11, a first wear strip 50A may be secured within the first track 240A to position the first wear strip 250A between the screed bar 190 and the base bar 160. The first wear strip 250A, for wear and friction reduction, may be HDPE (high density polyethylene). The first wear strip 250A may extend along the first direction to 170A (not shown, though the schematic illustration of the tack 240A in FIG. 10 is equally applicable to the first wear strip 250A), to define a first wear strip length that is substantially the same as first track length.

The first wear strip 250A may have a back end 250A1 and a front end 250A2 that are spaced apart from each other along the second direction 170B, to define a first wear strip height H(WS). The first wear strip 250A may define a T-shape cross section. With this shape, the first wear strip 250A may have a base portion 250A3 that extends from the back end 250A1 to an intermediate location 250A4, to define a base portion height H(BP). The base portion 250A3 may be sized and shaped to seat within the first track 240A. A flange portion 250A5 of first wear strip 250A may extend from the intermediate location 250A4 to the front end 250A2 of the first wear strip 250A, to define a flange portion height H(FP). The flange portion height may be smaller than the base portion height and the flange portion may be wider, e.g., in the third direction 170C, than the base portion 250A3.

In the non-limiting illustrated embodiment, the flange portion depth D(FP) of the first wear strip 150A2 may be less than 25% of the height of the second member 180B (FIG. 6) of the base bar 160. The front surface 180A3 of the second member 180B of the base bar 160 may have a second track 240B that has a same size and shape as the first track 240A and which may be spaced apart from the first track 240A along the third direction 170C to define a channel therebetween 265 having a channel height H(CH) in the third direction and a depth D(CH) that is the same as the wear track height. The channel allows for mounting the appendages (handles, motor, battery and rod mounts) to the base bar without interfering with the operation of the screed bar.

The screed 110 may include a second wear strip 250A that has a same size and shape and is formed of the same material as the first wear strip 250A and which is seated in the second track 240B. The first and second tracks 240A, 240B may be spaced apart from each other along the third direction 170C so that the first track 240A is aligned with the top end 190C of the screed bar 190 and the second track is aligned with the bottom end 190D of the screed bar 190.

Figure 12:
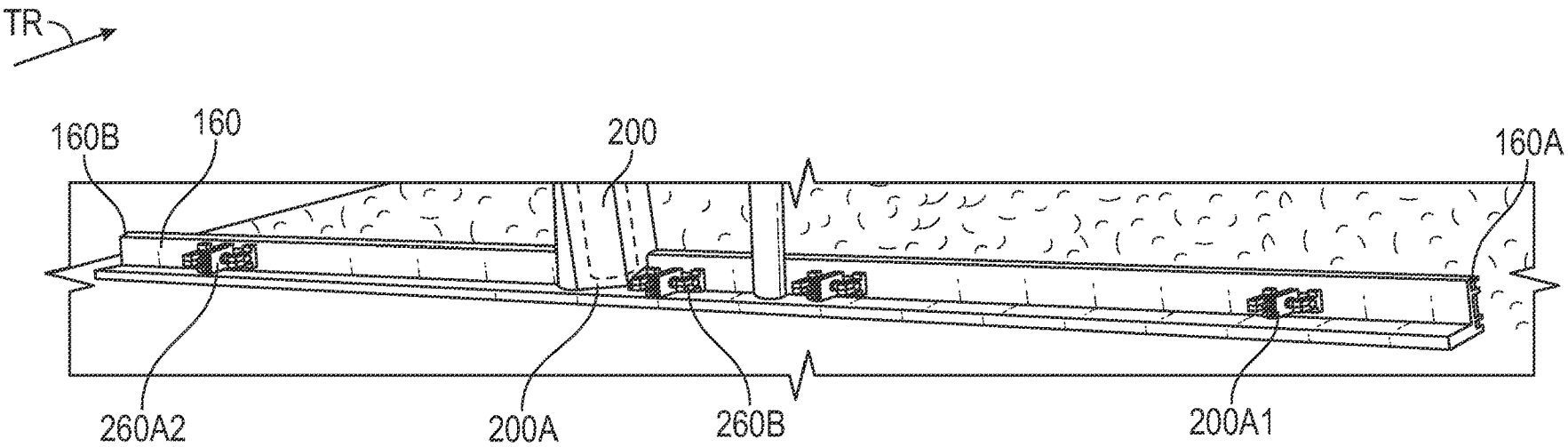
FIG. 12 shows the base bar as shown in FIG. 3 and further identifies guide systems that guide the screed bar against the base bar.

As shown in FIG. 12, the screed 110 includes linear guide systems generally referenced as 260, including outer guide systems 260A and a center guide system 260B that are the same as each other except as identified below. The center guide system 260B is located near the motor housing 200A and is operationally coupled to the motor 200 as indicated below. A first outer guide systems 260A1 is located near the first end 160A of the screed bar 160. A second outer guide system 260A2 is located near the second end 160B of the screed bar 160.

Figure 14:
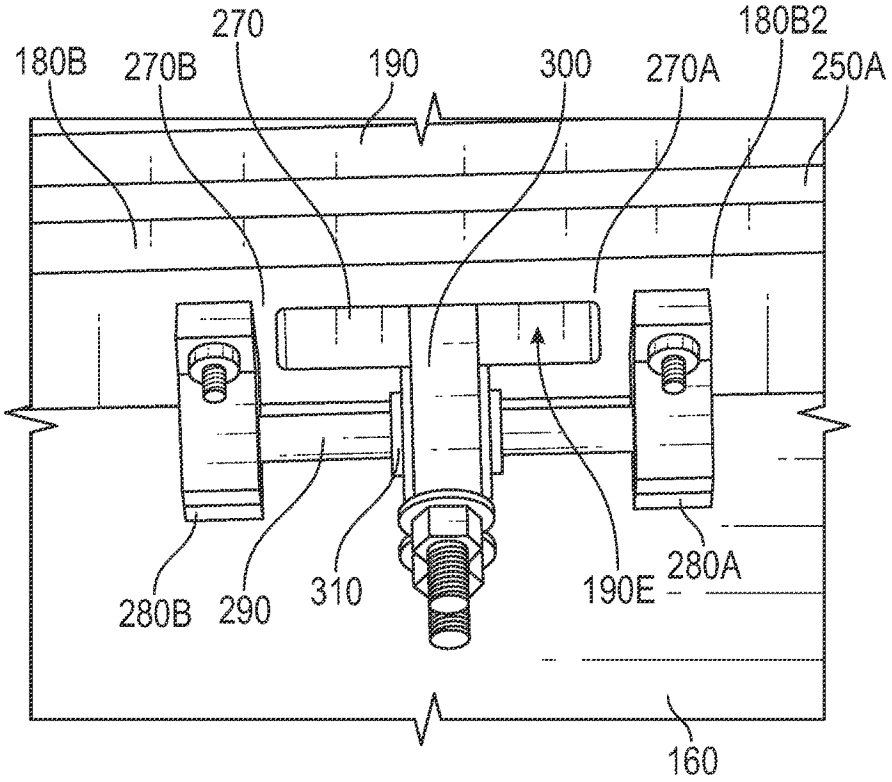
FIG. 14 is a top view of an outer guide system.
Figure 13:
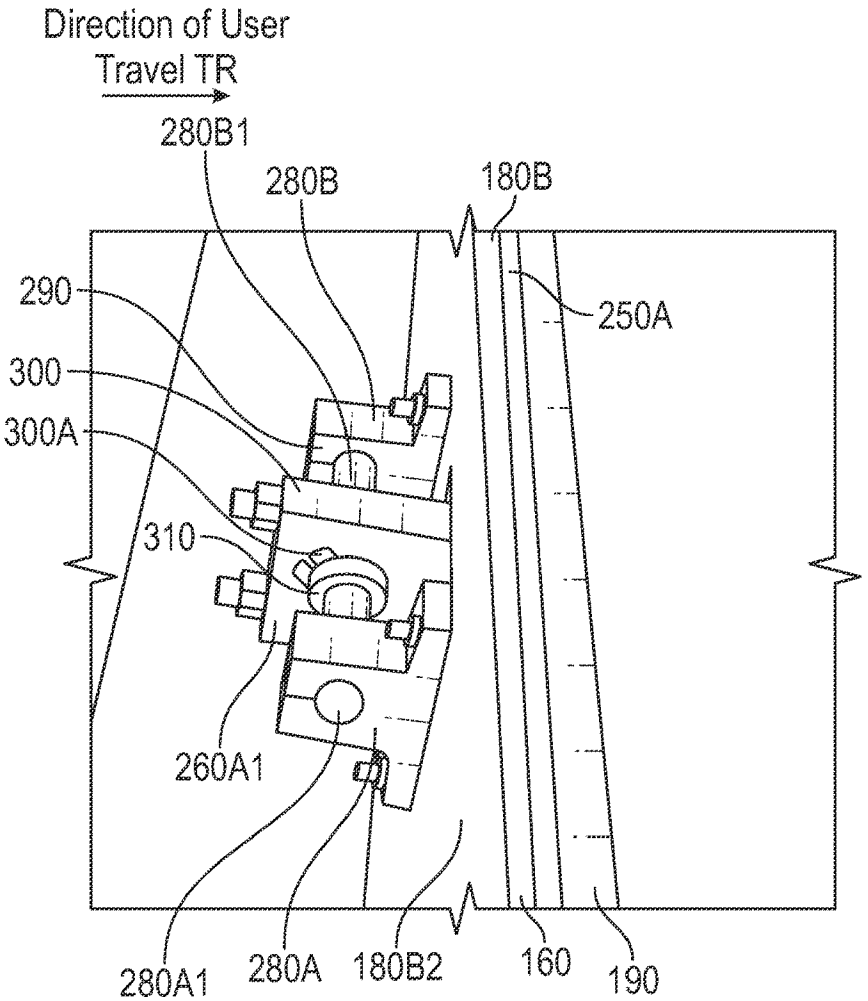
FIG. 13 is a perspective view of an outer guide system.

Turning to FIGS. 13 and 14, the first outer guide system 260A1 is shown. A slot 270 defined in the second member of the base bar 160. The slot 270 extends along the first direction 170A to define a first end 270A of the slot 270 and a second end 270B of the slot 270. A first bearing rod mount 280A is connected to the back surface 180B2 of the second member 180B of the base bar 180 at the first end 270A of the slot 270. A second bearing rod mount 280B is connected to the back surface 180B2 of the second member 180B at the second end 270B of the slot 270. A slide bearing rod 290 extends from the first bearing rod mount 280A to the second bearing rod mount 280B and is supported by the bearing rod mounts 280A, 280B, e.g., within respective first and second bar apertures 280A1, 280B1 in the first and second bearing rod mounts 280A, 280B.

A slide bearing mount 300 extends from the back surface 190E of the screed bar 190, through the slot 270. A guide aperture 300A is defined in the slide bearing mount 300, through which the slide bearing rod extends 290, permitting only linear movement (e.g., sliding) of the screed bar 190 against the base bar 160. A slide bearing 310 is disposed within the guide aperture 300A, which is configured to engage the slide bearing rod 290.

Figure 15:
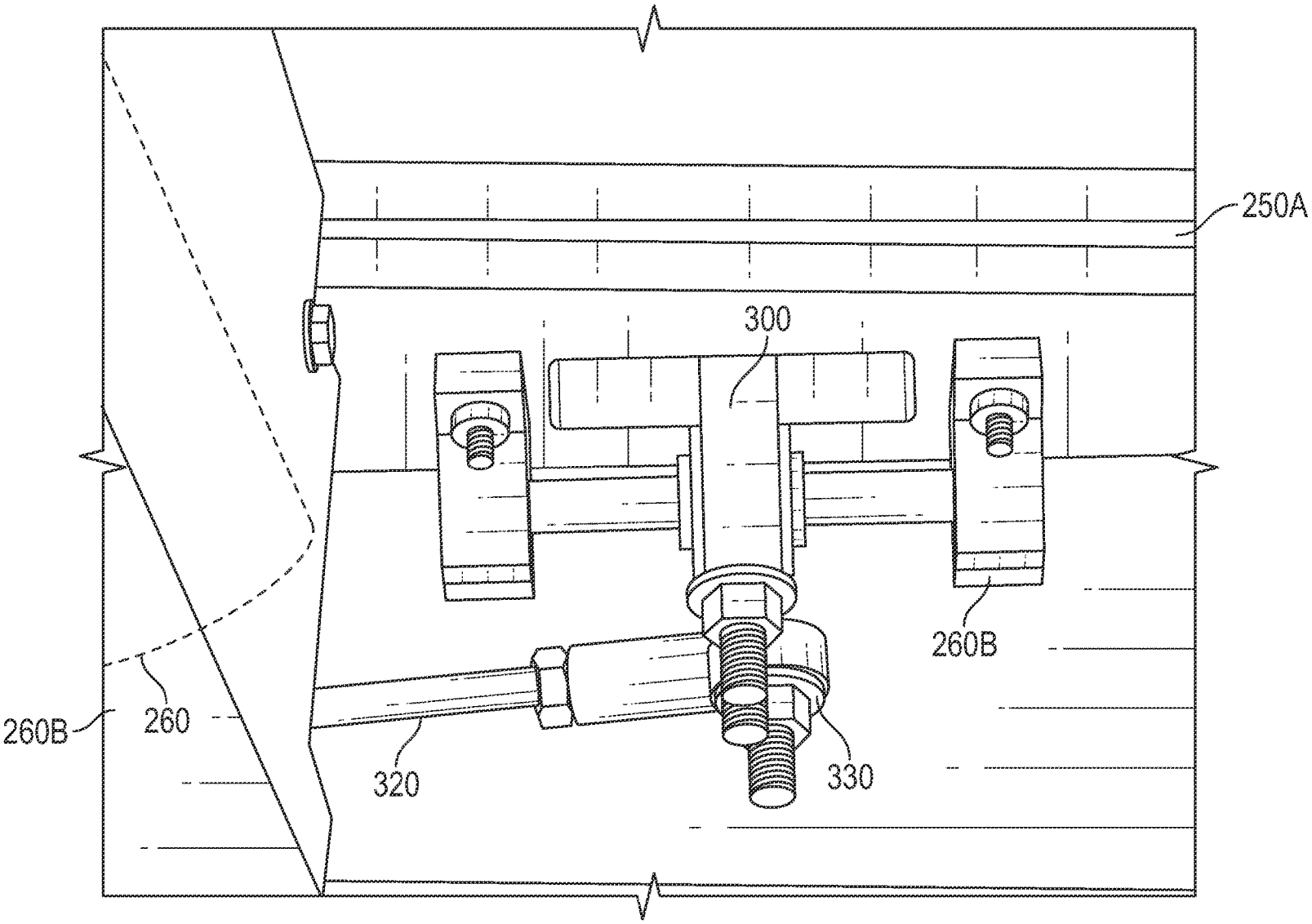
FIG. 15 is a top view of a center guide system.

Turning to FIG. 15, the center guide system 260B is shown. As indicated, the center guide system 260B is configured the same as the outer guide systems 260A except as identified herein. The motor 200 is operationally coupled to the slide bearing mount 300 of the center guide system 260B, e.g., by a link 320 with a pivotal connection 330 to the slide bearing mount 300 and a rotary connection to the motor 200, through the motor housing 200A. With this connection, the motor rotational output is configured to oscillate the screed bar 190. That is, the link 320 is connected to move by action of the motor 200 between minimum and maximum displacements along the first direction 170A, equivalent to the oscillatory amplitude. Movement of the link 320 results in oscillations of the slide bearing mount 300 of the center guide system 260B, which moves the screed bar 190 accordingly. The screed bar 190 is linearly guided to move only along the first direction 170A due to action of the guide systems 260.

Thus, the above embodiments provide a concrete screed that is capable of instant stopping and restarting on a wet slab and is light enough so it does not sink or damage a finished surface. The screed is electrical and is capable of producing minimal noise, no exhaust pollutants, does not require throttle cables, pull cords, oil, fuel or spark plugs of other screeds. The base bar of the screed is capable of gliding over wet concrete peaks or troughs and providing a level and finished surface.

As can be appreciated from the above discussion, the first, second and third directions are mutually perpendicular and are utilized for convenience. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

I claim:

1. A concrete screed device, comprising:

a handle structure defining a lower end and an upper end spaced apart from each other to define a screed handle structure height;

a base bar connected to the lower end of the handle structure;

a screed bar disposed against the base bar and configured to oscillate against the base bar; and a motor supported by the screed and operationally connected to the screed bar to oscillate within an oscillatory range of movement against the base bar.

2. The device of claim 1, further comprising a handle portion defined at the upper end of the handle structure.

3. The device of claim 1, further comprising a retractable stand, mounted to the handle structure member.

4. The device of claim 1, wherein:

the handle structure defines plural segments between the lower end and the upper end that are pivotally interconnected, to adjust a height of the device.

5. The device of claim 1, wherein:

the base bar has a first end and a second end spaced apart from each other in a first direction, to define a base bar length, wherein the screed bar is configured to oscillate against the base bar along the first direction;

the screed bar has a first end and a second end spaced apart from each other along the first direction, to define a screed bar length that is less than the base bar length; and the screed bar is configured such that it remains between the first and second ends of the base bar throughout the oscillatory range of movement.

6. The device of claim 5, wherein a difference in length between the base bar and the screed bar is the same as or greater than the oscillatory range of movement.

7. The device of claim 2, further comprising a motor control secured to the handle portion and operationally connected to the motor.

8. The device of claim 1, further comprising a power supply supported by the screed and electrically coupled to the motor.

9. The device of claim 1, further comprising a first wear strip disposed between the screed bar and the base bar.

10. The device of claim 9, wherein the first wear strip is an HDPE.

11. The device of claim 1, wherein:

the base bar is L-shaped and includes a first member and a second member connected at a joint;

the first member extends along a second direction from the joint to a first outer end, to define a base bar depth;

the second member extends along a third direction from the joint to a second outer end, to define a base bar height;

the first member also includes a top surface and a bottom surface spaced apart along the third direction, to define a first member depth;

the second member includes a front surface and a back surface spaced apart along the second direction, to define a second member depth; and the screed bar is configured to oscillate against the front surface of the second member.

12. The device of claim 11, wherein the screed bar includes:

a top end and a bottom end spaced apart from each other in the third direction, to define a screed bar height; and a front surface and a back surface spaced apart from each other in the second direction, to define a screed bar depth, wherein:

the screed bar is a same height as the base bar height; and the top end of the screed bar is aligned in the third direction with the outer end of the second member of the base bar.

13. The device of claim 11, wherein the front surface of the screed bar is concave to define a shovel or plow.

14. The device of claim 12, wherein:

the base bar includes a first wear strip track formed in the front surface of the second member of the base bar;

the first track extends along the second member of the base bar, in the first direction, from the first end to the second end of the base bar, so that a first track member length is substantially the same as the base bar length; and the first wear strip is secured to the first wear strip track.

15. The device of claim 14, wherein:

the first wear strip extends along the first direction to define a first wear strip length that is substantially the same as first track length;

the first wear strip has a front end and a back end that are spaced apart from each other in the second direction, to define a first wear strip depth;

the first wear strip defines a T-shape cross section including:

a base portion that extends from the back end to an intermediate location, to define a base portion height, wherein the base portion is sized and shaped to seat within the first track; and a flange portion that extends from the intermediate location to the front end, to define a flange portion height, wherein the flange portion height is smaller than the base portion height, and the flange portion is wider than the base portion.

16. The device of claim 15, wherein:

the front surface of the second member of the base bar includes a second track that has a same size and shape as the first track member and is spaced apart from the first track member along the third direction;

the device further includes a second wear strip that has a same shape and size as the first wear strip is seated in the second track; and the first and second tracks are located so that the first track is aligned with the top end of the base bar and the second track is aligned with the bottom end of the base bar.

17. The device of claim 11, further comprising a guide system, including:

a slot defined in the second member of the base bar, the slot extending along the first direction, to define a first and second ends of the slot;

a first bearing rod mount connected to the back surface of the second member at the first end of the slot and a second bearing rod mount connected to the back surface of the second member at the second end of the slot;

a slide bearing rod that extends from the first bearing rod mount to the second bearing rod mount;

a slide bearing mount that extends along the second direction, from the back surface of the screed bar, through the slot; and a guide aperture defined in the slide bearing mount, through which the slide bearing rod extends, permitting only linear movement of the screed bar against the base bar.

18. The device of claim 17, further comprising a slide bearing within the guide aperture which is configured to engage the slide bearing rod.

19. The device of claim 17, wherein the motor is operationally coupled to the slide bearing mount of the guide system such that the motor rotational output is configured to oscillate the screed bar.

20. The device of claim 18, wherein:

the guide system is a center guide system located near the motor, and the device includes:

a first outer guide system that is configured the same as the center guide system and is located near the first end of the base bar; and a second outer guide system that is configured the same as the center guide system and is located near the second end of the base bar.

* * * * *